US007971335B2

(12) United States Patent
Opper et al.

(10) Patent No.: US 7,971,335 B2
(45) Date of Patent: Jul. 5, 2011

(54) FASTENING APPARATUS AND METHOD WITH COMPENSATION FOR LOAD-INDUCED DEFORMATION OF SUPPORTING FRAME

(75) Inventors: Reinhold Opper, Buseck (DE); Rubén Gutiérrez Romero, Wetzlar (DE); Joachim Moeser, Alsfeld (DE)

(73) Assignee: Newfrey LLC, Newark, DE (US)

( * ) Notice: Subject to any disclaimer, the term of this patent is extended or adjusted under 35 U.S.C. 154(b) by 1302 days.

(21) Appl. No.: 11/517,275

(22) Filed: Sep. 8, 2006

(65) Prior Publication Data

US 2007/0056153 A1 Mar. 15, 2007

(30) Foreign Application Priority Data

Sep. 9, 2005 (DE) ..... 10 2005 043 211

(51) Int. Cl.
*B21J 15/02* (2006.01)

(52) U.S. Cl. ..... 29/525.06; 29/243.53; 29/432.1; 29/524.1; 29/798

(58) Field of Classification Search ..... 29/243.53, 29/432.1, 524.1, 525.06, 798
See application file for complete search history.

(56) References Cited

U.S. PATENT DOCUMENTS

| | | | | |
|---|---|---|---|---|
| 4,765,057 | A * | 8/1988 | Muller | 29/716 |
| 2008/0066286 | A1 * | 3/2008 | Saathoff | 29/432.1 |

FOREIGN PATENT DOCUMENTS

| | | | | |
|---|---|---|---|---|
| CN | 1485163 | A | * | 3/2004 |
| DE | 554 810 | C | | 7/1932 |
| DE | 10 2004 005 884 | A1 | | 8/2005 |
| EP | 0 835 731 | A2 | | 4/1998 |
| FR | 993 420 | A | | 10/1951 |
| GB | 2417452 | A | * | 3/2006 |
| JP | 48 097176 | A | | 12/1973 |
| WO | WO 97/27972 | A | | 8/1997 |
| WO | WO2005/075126 | A1 | | 8/2005 |

* cited by examiner

*Primary Examiner* — Paul D Kim
(74) *Attorney, Agent, or Firm* — Michael P. Leary

(57) ABSTRACT

Fastening apparatus comprises a frame having a pair of spaced arms supporting respective cooperable fastening members, loading of the frame during a fastening operation tends to spread the arms and cause variation of a desired predetermined relationship between the fastening members. One of the members is mounted on one arm of the frame by a holder constructed to deform elastically and thereby to provide at least partial compensation for the variation.

15 Claims, 3 Drawing Sheets

FASTENING APPARATUS AND METHOD WITH COMPENSATION FOR LOAD-INDUCED DEFORMATION OF SUPPORTING FRAME

CROSS-REFERENCE TO RELATED APPLICATION

This application claims the benefit of German Application DE 10 2005 043 211.5 filed Sep. 9, 2005, incorporated herein by reference.

BACKGROUND OF THE INVENTION

This invention relates to a fastening apparatus and method in which load-induced elastic deformation of a supporting frame is at least partially compensated, in order substantially to maintain a desired relationship of cooperable fastening members supported on respective spaced arms of a frame.

Apparatus for forming joints in workpieces, such as sheet metal, by so-called deformational fastening such as riveting, self-piercing riveting, or clinching, is well-known and is widely used in the automotive industry, for example. A fastening device used in such apparatus may comprise punch and die members mounted on respective arms of a C-frame, for example.

The shape of components to be joined to one another may necessitate a variety of positions of a tool (e.g., die) mounted by a holder on one frame arm opposite to a punch on another frame arm. In addition, a change in the maximum width of an opening between the punch and the tool is often required for optimal adaptation of a fastening device for different tasks.

In apparatus disclosed in DE 10 2004 005 884 A1, tool holders of different lengths are interchangeably mounted on an arm of a frame in order to change the tool position within the frame opening. In addition, the holder of a punch drive can be attached to another arm of the frame in two different positions to provide different distances from an opposing tool. In this way, the width of an opening between the punch and an opposing tool can be further changed.

The support of tools by tool holders of different lengths, the different positions of a formed joint relative to the frame, and the different positions of the punch drive have the result that when loads are applied to the frame in a fastening or joint-forming operation, the longitudinal axis of the punch on one arm of the frame and the longitudinal axis of a tool on the other arm of the frame deviate from their original in-line relationship by different amounts. Such angular deviations can affect a joint being formed, because the opposing faces of the punch and the tool vary from their initial parallel relationship as a function of the angular deviations. Such deviations can significantly degrade the quality of a joint and should not exceed a specific amount. Moreover, it is desirable that angular deviations, of an acceptable order of magnitude, be kept as close to equal as possible, and not depend on the position of a joint being formed within the frame opening.

Loading of the frame during a fastening or joint-forming operation may also produce an offset of a joint relative to the frame, i.e., perpendicular to the longitudinal axes of a punch and a cooperable tool. Such offsets can produce undesirable loads on parts being joined and on equipment carrying the frame, for example a robot, and should therefore be kept as small as possible irrespective of the joint positions.

BRIEF DESCRIPTION OF THE INVENTION

The present invention provides a fastening apparatus and method wherein load-induced elastic deformation of a supporting frame during a fastening or joint-forming operation is at least partially compensated. More particularly, angular deviation between longitudinal axes of fastening members supported on respective arms of the frame, and offset of a joint relative to the frame, are kept desirably small.

In a preferred embodiment, designed elastic deformation of a tool holder at least partially compensates for load-dependent spreading of the arms of a supporting frame. The tool holder bends under load in a direction opposite to the direction of bending of its frame arm, without degrading the stability and support function of the tool holder.

An advantage of the invention is that a smaller angular deviation, and thus better joint-forming results, can be achieved with little effort. The effect of transverse forces on an apparatus of the invention is reduced, and service life is improved.

When at least two tools having holders of different lengths are used interchangeably, angular deviations resulting from loading during joint forming can be made largely independent of the position of a tool in the apparatus and can be made to lie within a predetermined narrow range.

By selective variation of the resistance to deformation, in particular the bending strength, various tool holders can be adapted to particular load situations resulting from their individual length in such an manner that essentially the same maximum angular deviations result for each tool holder during joint forming, assuming identical process conditions.

Also, in accordance with the invention, the different tool holders of a tool holder set can be designed such that their elastic deformation under load at least partially compensates for offset of a joint relative to the frame and does not exceed a predefined maximum value. By limiting the offset, shear forces which load a workpiece and the joint-forming apparatus can be kept small.

Control of the elastic deformation of a tool holder used in the invention can be achieved by selecting particular structural configurations and/or by controlling material properties of the tool holder.

BRIEF DESCRIPTION OF THE DRAWINGS

The invention will be further described in conjunction with the accompanying drawings, which illustrate preferred (best mode) embodiments, and wherein:

In FIG. 8 a support for one of the fastening members is shown in a position that is reversed from the position shown in FIGS. 1, 6, and 7.

DETAILED DESCRIPTION OF THE INVENTION

The present invention addresses problems that occur when a frame is elastically deformed due to loading of the frame in an operation in which fastening members supported on respective arms of the frame engage opposite sides of juxtaposed workpieces. The fastening members may be cooperable tools such as a punch supported on one arm of the frame and a die supported in opposition to the punch on another arm of the frame. The invention is applicable to, but not limited to, riveting, self-piercing riveting, and clinching, for forming joints in sheet metal parts that fasten the parts to one another. By way of example, the invention will be described in its application to self-piercing riveting.

Figure 1:
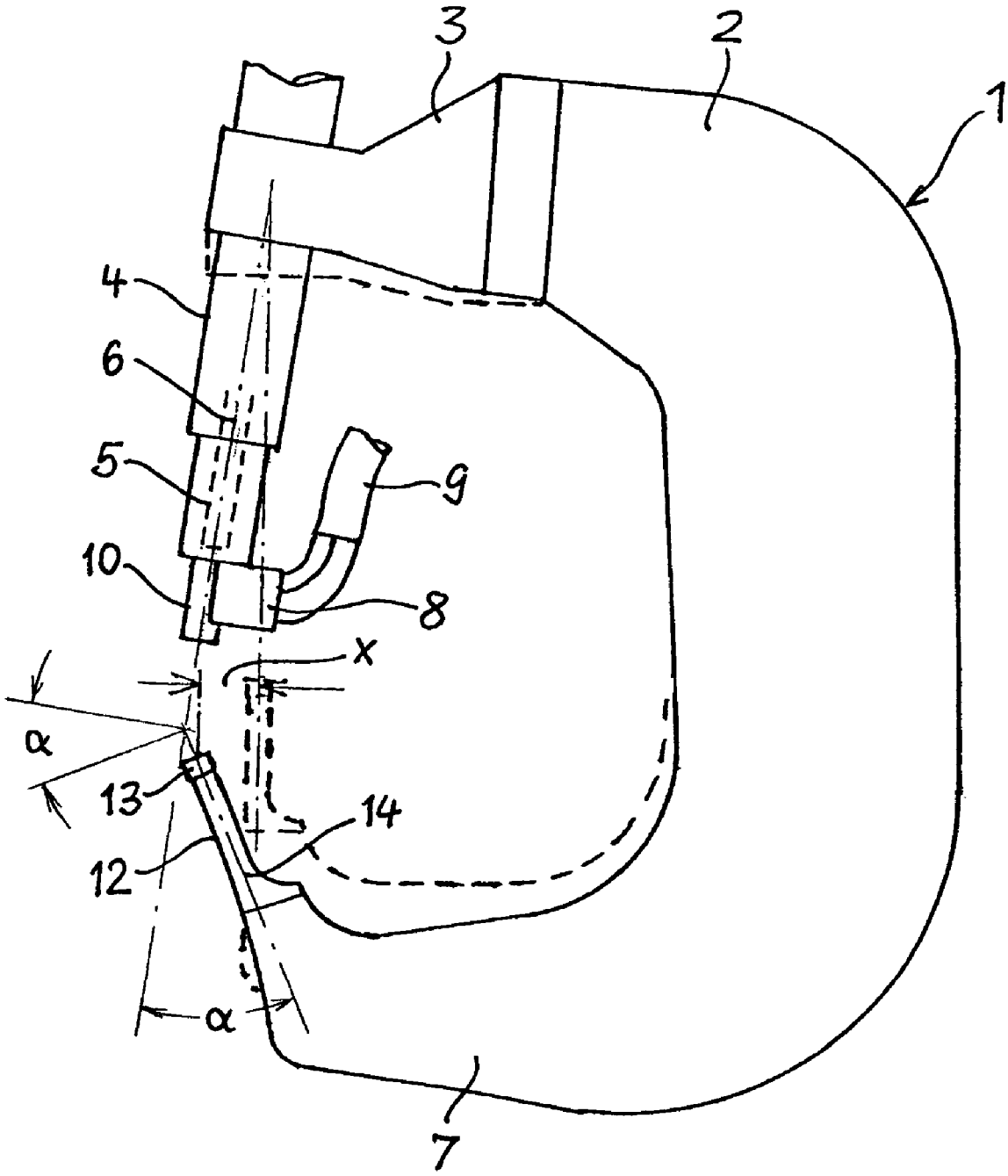
FIG. 1 is a somewhat diagrammatic elevation view showing a fastening apparatus comprising a C-frame and showing, greatly exaggerated, deformation of the C-frame due to loading in a fastening or joint-forming operation.

As shown in FIG. 1, in one embodiment, apparatus of the invention comprises a C-shaped frame 1, which typically is attached to an industrial robot that can move the apparatus into a desired working position. Attached to an arm 2 of the frame 1 (the top arm in FIG. 1) is a holder 3 which carries in a receiving bore a drive 4 for a punch 5 moveable in a longitudinal axis direction by the drive. The punch 5, located inside a housing of the drive 4, has, perpendicular to its longitudinal axis 6, an end face which acts on a self-piercing rivet to be set on a workpiece. A loader 8 loads self-piercing rivets, individually fed by a feeder tube 9, into a sleeve 10, where each rivet is held beneath the front face of the punch 5 for the next riveting operation.

Arranged on another arm 7 of the frame 1, opposite to the drive 4, is a tool holder 12, which carries at its free end a tool 13 (e.g., a die) on which workpieces are supported during the riveting operation. The tool holder 12 ensures, by means of its axial length, that the tool 13 is located a distance from the arm 7, thereby making it possible to fasten workpieces having a point of contact for the tool 13 in a recessed location. The tool 13 has a longitudinal axis 14 which coincides with the longitudinal axis 6 of the punch 5 when the frame is not loaded. The surface of the tool 13 that comes into contact with a workpiece during fastening is usually embodied as a surface of rotation about the longitudinal axis 14.

As is typical of self-piercing riveting apparatus, the punch drives a self-piercing rivet into one workpiece and into a juxtaposed workpiece, where the legs of the rivet are bent so as to fasten the workpieces to one another and form a joint.

FIG. 1 shows, with great exaggeration for the purposed of illustration, deformation of the frame 1 under heavy load during a final phase of a joint-forming operation, with accompanying misalignment of the punch 5 and the die 13, due to loading of the frame. More particularly, the deformation of the frame can involve spreading of the arms so as to vary the spacing of the arms and the position at which a joint is formed. In FIG. 1 the dash lines show the positions of the arms 2 and 7 initially, before a joint-forming operation, and the solid lines show the positions of the arms when the frame 1 is deformed during a joint-forming operation.

As shown, due to deformation of the frame 1 the longitudinal axes 6 and 14, which initially were aligned, now diverge from one another to form an angle $\alpha$ which corresponds to the sum of the angular deviations of the two longitudinal axes from their initial positions. At the same time, an angle $\alpha$ is formed by the end faces of the punch 5 and the die 13 under load conditions. This angle is called the spread angle, since it specifies the degree to which the end faces of the punch and die are spread apart from one another.

During a joint-forming operation, this spreading affects the workpieces and leads to uneven formation of the joint, degrading its quality or durability. It is desirable to keep the spreading, and thus the angular deviation of the longitudinal axes of the punch and die, as small as possible. The size and weight of the apparatus present limiting factors, however. As a general rule, minimal spreading and maximum angular deviation on the order of less than 1 degree can be tolerated.

In order to be able to reduce the spread angle to such a value without costly changes in the frame, a tool holder of the invention is constructed such that, as a result of the loading during fastening, it undergoes an elastic deformation that at least partially compensates for the spreading of the arms of the frame. This can be accomplished by providing a middle portion of the tool holder with a narrowed region of reduced thickness that is designed in such a manner that the tool holder deforms under load with a type of buckling that accomplishes a reduction in the spreading of the end faces of the punch and the tool.

It is further evident in FIG. 1 that the elastic deformation of the frame 1 due to loading during a joint-forming operation causes an offset of a joint transverse to the direction of the joining force. In FIG. 1 the offset x accompanies the angular deviation between the longitudinal axes of the punch and the die. It is desirable that the offset, like the angular deviation, be limited to a small maximum amount, e.g. 1 mm. In accordance with the invention, as a result of a design of a tool holder's elastic deformation properties under loads, the offset can be limited to an advantageously small value as well.

Succinctly stated, the present invention provides a mechanism by which the effects of elastic frame deformation under loading are at least partially compensated. Such compensation is achieved by controlling the construction of at least one tool holder, as by selecting an appropriate structural configuration and/or material properties of the tool holder.

Figure 2:
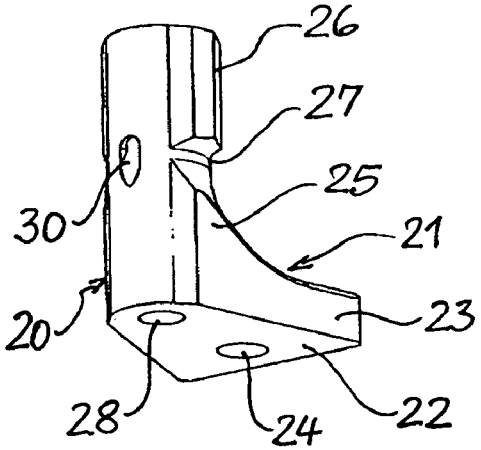
FIG. 2 is a perspective view of a tool holder of short axial length as seen from the bottom, rear and one side of the tool holder.
Figure 3:
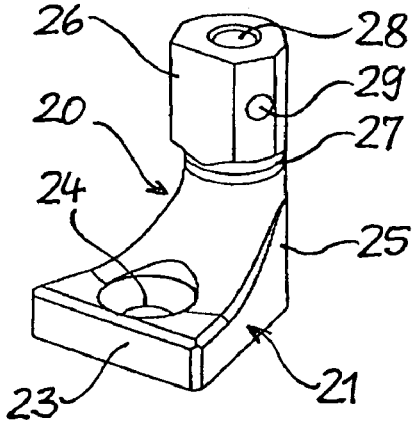
FIG. 3 is a perspective view of the tool holder in FIG. 2 as seen from the top, front, and opposite side.

FIGS. 2 and 3 show an embodiment of a tool holder that is constructed to bend under loads in a manner that moves a held tool in a direction that minimizes undesired angular deviations and offset. The tool holder 20 is formed of a material (e.g., steel) that has suitable elastic deformation behavior. It has a plate-like base 21 with a flat bottom surface 22 by which the tool holder is supported on an arm of the frame (e.g., arm 7 in FIG. 1). In the form shown, the tool holder 20 has a curved upper section 25 and a flatter lower section 23 with a mounting hole 24 for receiving a retaining pin (not shown). The upper section 25 bears a larger head 26 and transitions continuously into the lower section 23.

Located between the upper section 25 and the head 26 is a necked-in (notched) middle section 27, which is a configured such that the head 26 inclines slightly toward the front of the lower section 23. Under loading, the inclination of the head 26 increases elastically to reduce the angular deviation caused by spreading of the frame 1.

The tool holder 20 has a bore 28 that passes through the head 26, the middle section 27, the upper section 25, and the lower section 23, perpendicular to the bottom surface 22. The hole 28 accommodates a retaining pin of a tool (e.g., a die) placed on the head. The part of the hole 28 located in the base 21 accommodates a centering pin with which the tool holder 20 is centered in axial alignment with the punch on an opposite arm of the frame. A lateral threaded hole 29 in the head 26 accommodates a locking screw with which the pin of the tool is clamped in place in the bore 28. An angled hole 30 that opens into the bore 28 provides access to the pin in the bore for loosening the tool from the holder.

Figure 4:
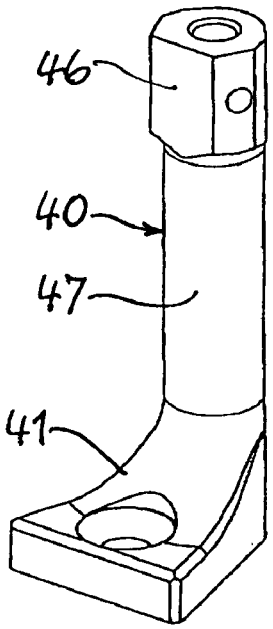
FIGS. 4 and 5 are views similar to FIG. 3 but showing different tool holders of medium and long axial length, respectively.
Figure 5:
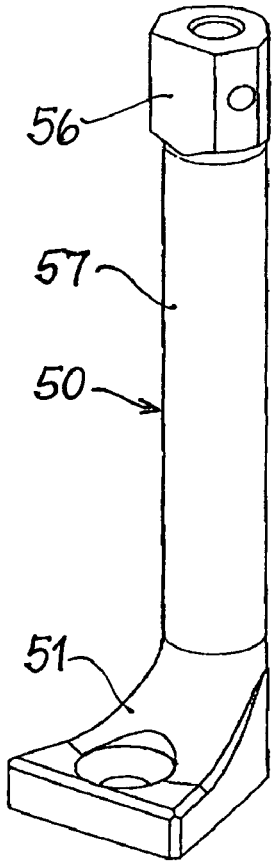

FIG. 4 shows a tool holder 40 that is of medium length in comparison with the tool holder 20 and the tool holder 50 shown in FIG. 5. Tool holder 40 has a base 41 and a head 46. The shape and size of the base 41 match the base 21, and the shape and size of the head 46 match the head 26. A greater axial length of the tool holder 40 is due solely to the length of a cylindrical section 47 that connects the head 46 to the base 41. The stiffness of the section 47 is made commensurate with the axial length of the tool holder 40, such that under loading that acts on the tool holder 40 in a fastening operation, the section 47 bends and the head 46 undergoes a change of position that at least partially compensates for the angular deviation and offset caused by spreading of the frame. This can be accomplished by providing a necked-in (notched) region (not shown) or by other techniques described later.

The tool holder 50 in FIG. 5 has a base 51 and a head 56 matching the corresponding base and head of the tool holders 20 and 40. Section 57 is approximately twice as long as section 47 of the tool holder 40, and its deformation behavior under load is matched to a requirement resulting from the length of the tool holder. Again, the stiffness of the section 57 is made commensurate with the axial length of the tool holder 50, such that under loading that acts on the tool holder 50 in the fastening operation, section 57 bends and the head 56 undergoes a change of position that at least partially compensates for the angular deviation and offset caused by spreading of the frame. The stiffness of the section 57 can be controlled in the same manner as the stiffness of the tool holders 20 and 40.

By selective variation of the resistance to deformation, in particular the bending strength, the various tool holders can be adapted to particular load situations involving their length, in such a manner that essentially the same maximum angular deviations and offset result during joint forming for each tool holder, assuming identical operational conditions. In accordance with the invention, the tendency of a relatively long tool holder to buckle can be promoted by appropriate weakening of its cross-section.

The invention benefits from a design in which various tool holders have a uniform base and a uniform head and in which the head and the base are joined by a narrowed central section whose deformation under load is optimized for maintaining a predefined angular deviation. The narrowed central region may have the shape of a circular cylinder. However, other shapes, including parts that are conical, elliptical, or polygonal, for example, may be useful. In addition to influencing the deformation behavior under load through the geometric design of the tool holders, measures for changing the strength properties of the material of the central section can be utilized. Desired deformation can be achieved through zonal alternation of the material properties of the central section, as by work-hardening, tempering, or annealing of steel, for example. More particularly, a frontal zone of the central section can have its material properties altered so that it is weakened to promote bending in the desired direction. A similar effect might be achieved by altering the material properties of a rear zone of the central section to increase its stiffness relative to a frontal zone.

Together, the tool holders 20, 40, 50 constitute a tool holder set designed for use in a particular apparatus of the invention. The design is executed in this regard in such a manner that under identical loading in the fastening device all three tool holders 20, 40, 50 produce the same angular deviation between the longitudinal axes of the punch and the opposed tool. The use of such a tool holder set will be briefly described as illustrated in FIGS. 6-8, all of which show the of frame 1 in an un-loaded state.

Figure 6:
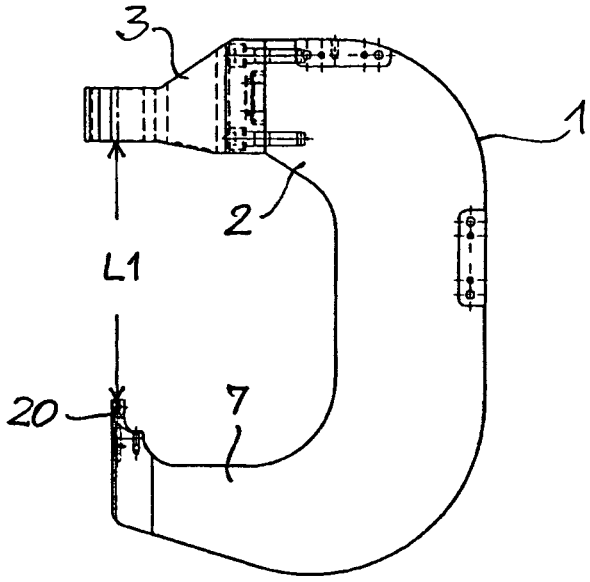
FIGS. 6, 7, and 8 are views similar to FIG. 1 using tool holders shown in FIGS. 2-3, 4, and 5, respectively.

In FIG. 6, the short tool holder 20 is attached to the arm 7 of the frame 1. The punch holder 3, which is attached to the arm 2 provides a distance L1 between the head of the tool holder 20 and the holder 3.

Figure 7:
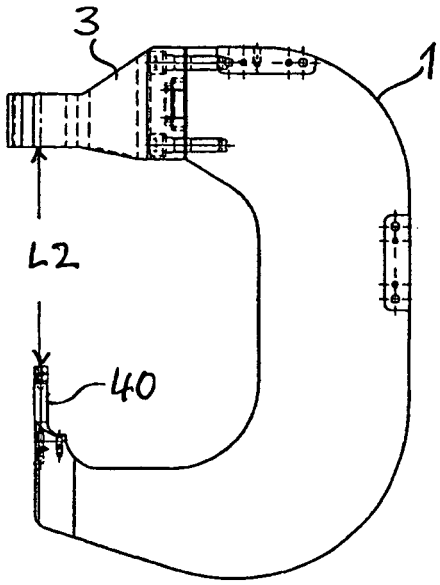

In FIG. 7, the tool holder 20 is replaced by the tool holder 40, reducing the distance between the respective tool holders to a smaller distance L2.

Figure 8:
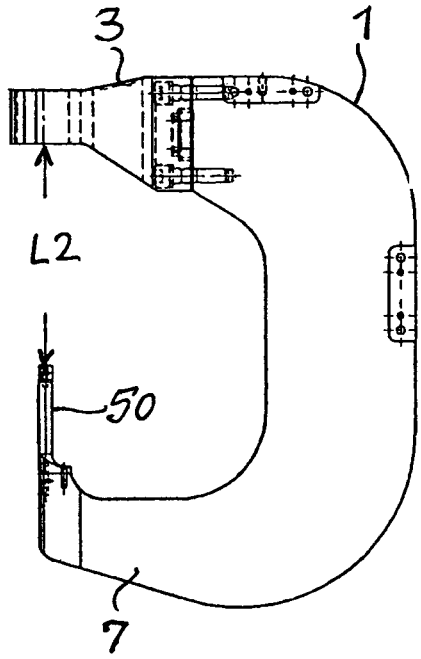

FIG. 8 shows an arrangement in which the tool holder 3 is installed on its arm reversed from the installation arrangement shown in FIGS. 6 and 7, so that its punch-receiving section has a greater distance from the arm 7 of the frame 1. Attached to the arm 7 is the long tool holder 50. Its greater length compensates for greater separation from the tool holder 3, so that the separation between the head of the tool holder 50 and the holder 3 is again equal to L2.

The three tool holders 20, 40, 50 in combination with the two installation positions of the holder 3 provide six different permutations. By virtue of the invention, it is possible in all six different permutations to bring the spread angle to a small value that changes only to a small degree from permutation to permutation.

While preferred embodiments of the invention have been shown and described, it will be apparent that changes can be made without departing from the principles and spirit of the invention, the scope of which is defined in the accompanying claims. For example, although the invention has been described in connection with fastening or joint-forming operations, it will be apparent that the invention can be used in other applications, such as applications in which cooperable tools emboss a workpiece.

What is claimed is:

1. A fastening apparatus comprising a frame having a pair of spaced arms supporting respective cooperable fastening members, wherein the frame is subjected to loads during a fastening operation tending to spread the arms and to cause variation of a predetermined desired relationship between the fastening members, and wherein one of the members is mounted on one arm by a holder, and the holder includes a narrowed region of reduced stiffness constructed to bend elastically in a predetermined direction and thereby to provide at least partial compensation for the variation.

2. The fastening apparatus according to claim 1, wherein the frame is a C-frame.

3. The fastening apparatus according to claim 1, wherein one of the fastening members comprises a punch moveable along its longitudinal axis and the other fastening member comprises a die having a longitudinal axis initially aligned with the longitudinal axis of the punch.

4. The fastening apparatus according to claim 3, wherein the variation comprises an angular deviation of the respective axes.

5. The fastening apparatus according to claim 3, wherein the variation comprises an offset of one of the axes relative to the other.

6. The fastening apparatus according to claim 3, wherein the punch is mounted on an arm of the frame by a support that provides for variation of the distance between the punch and the die.

7. The fastening apparatus according to claim 1, wherein the compensation involves material properties of the holder.

8. The fastening apparatus according to claim 1, wherein said one member is part of a set of members interchangeably mounted on said one arm by respective holders of different lengths, and wherein the holders are constructed to provide substantially the same amount of compensation irrespective of which holder is mounted on said one arm.

9. A fastening apparatus comprising a frame having a pair spaced arms supporting a punch and a die, respectively, wherein, during an operation in which the punch applies a force to a workpiece juxtaposed with the die, the frame is subjected to loads tending to spread the arms and to cause a variation by deviation from a desired predetermined relationship between the punch and the die, and wherein the die is supported on one arm of the frame by a holder constructed, and the holder includes a narrowed region of reduced stiffness constructed to bend elastically in a predetermined direction and thereby to provide at least partial compensation for the variation.

10. The fastening apparatus according to claim 9, wherein the punch has a longitudinal axis initially aligned with a longitudinal axis of the die, and the variation comprises an angular deviation of the respective axes.

11. The fastening apparatus according to claim 9, wherein the punch has a longitudinal axis initially aligned with a longitudinal axis of the die, and the variation comprises an offset of one of the axes relative to the other.

12. The fastening apparatus according to claim 9, wherein the compensation involves material properties of the holder.

13. The fastening apparatus according to claim 9, wherein the die is part of a set of dies interchangeably mounted on said one arm by respective holders of different lengths, and wherein the holders are constructed to provide substantially the same amount of compensation irrespective of which holder is mounted on said one arm.

14. A joining device for deformational joining, the joining device comprising:

a C-Frame including a first end and a second end;

a movable punch and a punch drive mounted to the first end along a first longitudinal axis; and a tool holder mounted to the second end and supporting a die opposite to the punch and along a second longitudinal axis, and the second longitudinal axis is coaxial with the first longitudinal axis when the joining device is not performing a joining operation, the tool holder including:

a base section mounted to the second end;

a head section mounting the die; and a notched middle section of reduced stiffness;

whereby, when during a joining operation a force generated by the punch drive causes a spreading of the first end and the second end, so that a deviation arises between the no longer coaxial first axis and second axis, then the notched middle section elastically deforms under load in a direction that at least partially compensates for the spreading induced deviation.

15. The joining device according to claim 14, wherein, during a joining operation the elastic deformation of the notched middle section causes a load dependent movement of the die relative to the frame and transverse to an axis of the joining force.

* * * * *